US006631657B1

(12) United States Patent
Griebel et al.

(10) Patent No.: US 6,631,657 B1
(45) Date of Patent: Oct. 14, 2003

(54) CONTROL CAM FOR A VALVE-CONTROLLED INTERNAL COMBUSTION ENGINE

(75) Inventors: Claus-Otto Griebel, Groebenzell (DE); Juergen Thams, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 459 days.

(21) Appl. No.: 09/091,020

(22) PCT Filed: Sep. 19, 1997

(86) PCT No.: PCT/EP97/05152

§ 371 (c)(1),
(2), (4) Date: Oct. 26, 1998

(87) PCT Pub. No.: WO98/15722

PCT Pub. Date: Apr. 16, 1998

(30) Foreign Application Priority Data

Oct. 8, 1996 (DE) ..... 196 41 418

(51) Int. Cl.[7] ..... F16H 53/00
(52) U.S. Cl. ..... 74/567; 123/90.6
(58) Field of Search ..... 74/567–569; 123/90.6, 123/90.57, 90.55, 90.12, 90.15

(56) References Cited

U.S. PATENT DOCUMENTS

| | | | | | |
|---|---|---|---|---|---|
| 2,628,605 | A | * | 2/1953 | Jones et al. | 123/90.6 |
| 2,647,500 | A | * | 8/1953 | Lang | 123/90.6 |
| 2,804,863 | A | * | 9/1957 | Wolf-Dieter | 123/90.6 |
| 3,981,281 | A | * | 9/1976 | Deschler et al. | 74/567 X |
| 4,084,568 | A | * | 4/1978 | Sato et al. | 123/90.6 X |
| 4,424,790 | A | * | 1/1984 | Curtil | 123/90.6 X |
| 4,878,462 | A | * | 11/1989 | Kurisu et al. | 123/90.6 X |
| 4,909,196 | A | * | 3/1990 | Nagahiro et al. | 123/90.6 X |
| 5,215,048 | A | * | 6/1993 | Kaiser et al. | 74/567 X |
| 5,309,872 | A | * | 5/1994 | Filippi et al. | 123/90.15 |
| 5,503,120 | A | * | 4/1996 | Shirey et al. | 123/90.12 |
| 5,647,310 | A | | 7/1997 | Kimura | 123/90.6 |
| 5,860,399 | A | * | 1/1999 | Speil et al. | 123/90.57 |

FOREIGN PATENT DOCUMENTS

| | | | | |
|---|---|---|---|---|
| DE | 2 013 611 | | 10/1971 | |
| DE | 23 36 861 | | 6/1975 | |
| DE | 2809915 | * | 9/1979 | 123/90.6 |
| FR | 963412 | * | 7/1950 | 123/90.6 |

OTHER PUBLICATIONS

"A Decade of continuous Challenges", Public relations Division of Honda Motor Co., Ltd., Japan, pp. 136–137.

"Etude Dynamique de la Distribution dans les Moteurs a Combustion Interne", 1972, pp. 1–138.

Patent Abstract of Japan, No. 1–159417 (A) Jun. 22, 1989.

* cited by examiner

*Primary Examiner*—Vinh T. Luong
(74) *Attorney, Agent, or Firm*—Crowell & Moring LLP

(57) ABSTRACT

For a peripheral cam for a valve-controlled internal-combustion engine, having a cam contour which generates at least one positive acceleration course in the valve opening area, the gas dynamics, are advantageously influenced in that the peripheral cam has an opening flank with a contour causing a delayed opening acceleration course. The opening acceleration course is generated with acceleration curves with relatively high acceleration peak values of different amounts spaced by way of an intermediate curve of relatively low positive acceleration values. A first acceleration curve has a peak value of approximately 40 to 60% of a peak value of an adjacent acceleration curve set at 100%.

12 Claims, 1 Drawing Sheet

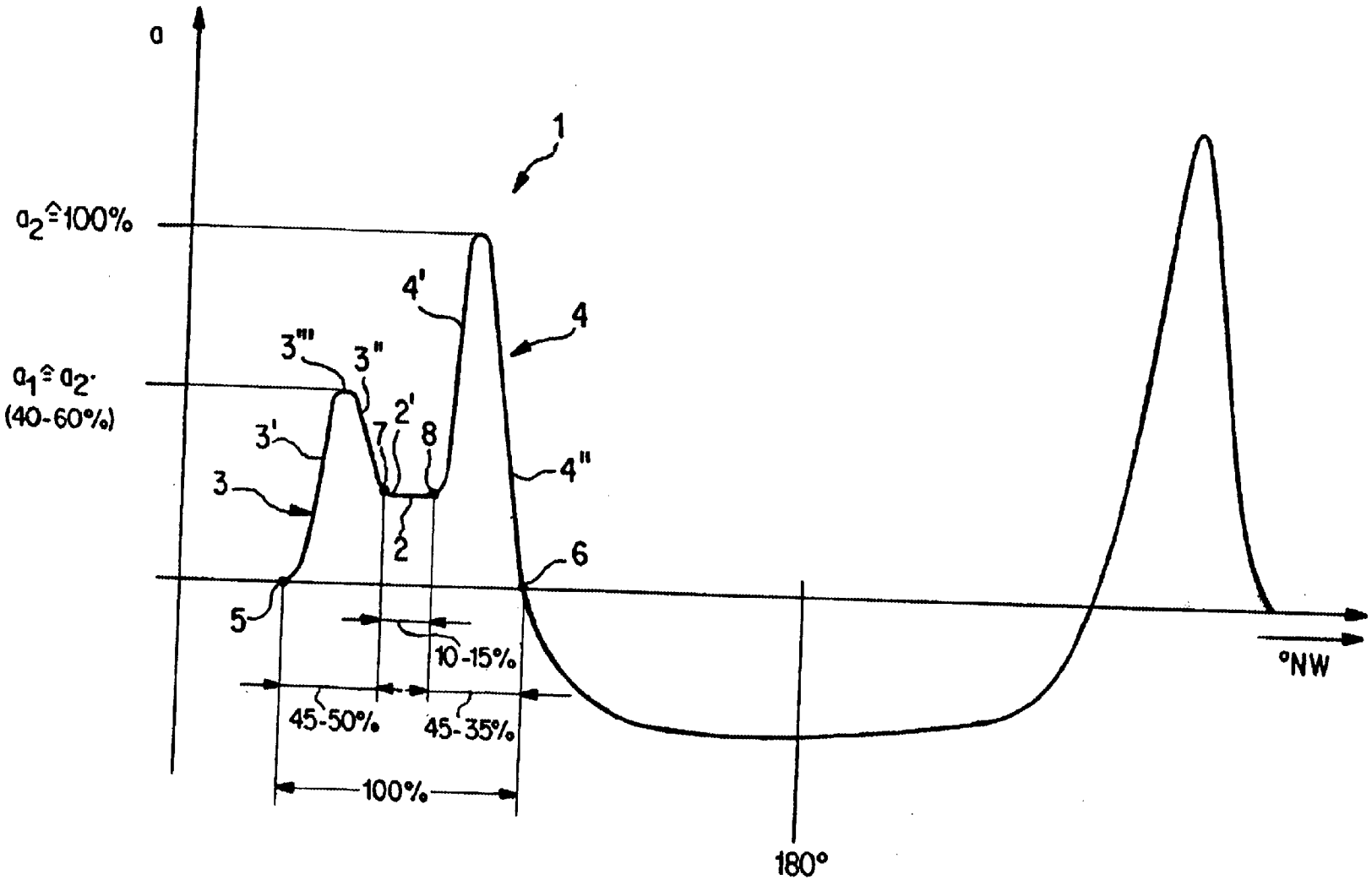
1
4
4'
4''
6
8
2'
2
7
3''
3'''
3'
3
5
10-15%
45-35%
45-50%
100%
180°
°NW
a
$a_2 \hat{=} 100\%$
$a_1 \hat{=} a_2'$
(40-60%)

CONTROL CAM FOR A VALVE-CONTROLLED INTERNAL COMBUSTION ENGINE

BACKGROUND OF THE INVENTION

The present invention relates to an internal combustion engine peripheral cam having a cam contour, and more particularly, to a cam contour which generates at least one positive acceleration course in the valve opening area, with an opening acceleration course which had two acceleration curves with relatively high acceleration peak values of different amounts spaced by means of an intermediate curve of a relatively low positive acceleration.

For achieving high specific operations for a close torque, on one hand and a high power on the other hand, internal-combustion engines are conventionally provided with a valve timing which has very "sharply defined" valve lift courses for the inlet and outlet valves in order to obtain the desired flow rates by way of correspondingly rapidly changing valve opening cross-sections. With rapidly opening outlet valves, a very high exhaust lead push is therefore generated which causes a non-uniform outflow of the exhaust gases. Since, however, the exhaust gas acoustics are very significantly influenced by the form and the amplitude of the exhaust lead push, a lead-out noise occurs in a high flow rate and a high opening acceleration of the outlet valve which has a high proportion of higher harmonics. This results in an intensified disadvantageous surface radiation of the exhaust gas system and of the internal-combustion engine.

In known production engines with large outlet cross-sections generated by several outlet valves per cylinder unit and high opening accelerations produced by sharply defined valve lift courses, this problem was solved in that the outlet cams provided for controlling the outlet valves per cylinder are arranged in an angularly offset manner with respect to one another (phasing). This arrangement which is, for example, also described in DE-C 39 33 021 or Japanese Patent Application 1-159 417 has the considerable disadvantage that each cam has to be ground separately.

The high-expenditures phasing arrangement described in DE-C 195 21 141 or U.S. Pat. No. 5,647,310, in the case of an outlet cam, is replaced in that its cam contour causes an asymmetrical valve acceleration curve with an opening acceleration curve whose maximal value is lower than that of the closing acceleration curve. However, such an asymmetrical outlet valve acceleration curve is known from the book "A Decade of Continuous Challenges" published by Honda Co. in Japan in 1993 under No. ISBN 4-9900262-0-9, from the illustrations on pages 136 and 137.

It is known that the surfaces under the closing acceleration curve and the opening acceleration curve should be the same so that the base of the known opening acceleration curve having approximately 50% of the maximal value of the closing acceleration curve extends along a larger angle-of-rotation range of the cam on the abscissa. Such a widening of the base of the acceleration curve also exists by way of the above-described phasing arrangement during the opening of several outlet valves of a cylinder by the superpositioning of the individual opening acceleration curves. Consequently, a predetermined widening of the base, while taking into account the above-mentioned sameness of the surfaces, causes each opening acceleration curve to be reduced in its maximal value for reducing an exhaust lead push.

Further, an opening acceleration course for a peripheral cam with two relatively narrowly adjacent acceleration curves of different maximal values along a joint broad base is known, for example, from FIG. 38, page 85 of "Etude Dynamique de la Distribution dans les Moteurs à Combustion Interne".

SUMMARY OF THE INVENTION

An object of the present invention is to dimension the cam contour of the peripheral cam at least for the valve opening area such that the gas dynamics of the internal-combustion engine on the outlet side and/or the inlet side are favorably influenced by way of the opening acceleration course.

This object has been achieved by providing that the first acceleration curve has a peak value of approximately 40 to 60% of a peak value of the adjacent second acceleration curve set at 100%, and in that the ascending curve section of the first acceleration curve and the descending curve section of the second acceleration curve form at least one projected intersection respectively with the zero acceleration line on the abscissa, the distance between respective connection points of the descending curve section of the first acceleration curve and of the ascending curve section of the second acceleration curve with the intermediate curve corresponding to an amount of 10 to 15% of the distance of the abscissa intersections set at 100%.

An advantage of the present invention is an opening acceleration course with two acceleration curves for whose connecting intermediate curve, a dimensioning range is indicated which is advantageous with respect to the extent of the acceleration delay. Thereby, when the peripheral cam dimensioned according to the present invention is used as an outlet cam for actuating an outlet valve, an exhaust lead push which is critical with respect to the exhaust gas acoustics is securely avoided. For an internal-combustion engine with several outlet valves per cylinder, another advantage is that an angularly offset arrangement of the outlet cams for a cylinder unit is unnecessary and therefore all outlet cams can be machined by one grinding wheel.

The opening acceleration course according to the present invention with a first acceleration curve and a second acceleration curve which is higher than the first has, in a further embodiment of the present invention for an intermediate curve connecting the two acceleration curves, a dimensioning range which is advantageous with respect to the extent of the acceleration delay.

In a further feature of the present invention, measurement ranges of the two acceleration curves of the opening acceleration course which have different levels relate to the abscissa of an acceleration diagram. The measurement range or lay-out range which is relatively larger particularly for the first acceleration curve, in conjunction with a constant acceleration in the summit range of the first acceleration curve and a constant acceleration of the intermediate curve between their connection points by way of these steadying sections results in an acceleration delay which has an advantageously favorable effect on the gas dynamics.

This acceleration delay achieved according to the present invention causes on the outlet side a significant reduction of the lead-out noise and thus of the surface radiation. On the inlet side, the opening acceleration course according to the present invention has a delay for a dynamic gap formation to increase the gas velocity for whirl formation.

BRIEF DESCRIPTION OF THE DRAWING

Other objects, advantages and novel features of the present invention will become apparent from the following detailed description of the invention when considered in conjunction with the accompanying drawings wherein:

The sole FIGURE is a diagram showing the acceleration course of the present invention, which acceleration course is of a type ordinarily used in the art to describe cam contours.

DETAILED DESCRIPTION OF THE DRAWING

The starting point of the present invention is a known peripheral cam for a valve-controlled internal-combustion engine, which has a cam contour generating at least one positive acceleration course in the valve opening area. Cam contours with high opening accelerations at high flow rates cause an exhaust lead push at outlet valves of the internal-combustion engine whose form and amplitude results in disadvantageous exhaust gas acoustics.

In order to, in particular, avoid the higher harmonics connected with the lead-out noise of the exhaust lead push, a delayed opening acceleration course is provided according to the present invention. For this purpose, the peripheral cam preferably has an opening flank with a contour by way of which an opening acceleration course 1 is generated which has acceleration curves 3, 4 spaced by an intermediate curve 2 of relatively low positive acceleration values and having relatively high acceleration peak values $a_1$, $a_2$ of different amounts such that the first acceleration curve 3 has a peak value $a_1$ of approximately 40 to 60% of a peak value $a_2$ of the adjacent acceleration curve 4 set at 100%.

The peripheral cam, which is preferably used as an outlet cam for actuating an outlet valve also has, with respect to its contour of the opening flank, the effect that the ascending curve section 3' of the first acceleration curve 3 and the descending curve section 4" of the second acceleration curve 4 form at least one projected intersection 5, 6 with the zero acceleration line on the abscissa or degrees of cam rotation of the acceleration diagram, in which case the distance between respective connection points 7, 8 of the descending curve section 3" of the first acceleration curve 3 and of the ascending curve section 4' of the second acceleration curve 4 with the intermediate curve 2 corresponds to an amount of 10 to 15% of the distance of the abscissa intersections 5, 6 set at 100%.

Further, the contour of the opening flank is configured such that the distance between the first abscissa intersection 5 of the first acceleration curve 3 and the first connection point 7 of the intermediate curve 2 to the first acceleration curve 3 corresponds to an amount of 45 to 50%, and the distance between the second connection point 8 of the intermediate curve 2 and the second abscissa intersection 6 of the second acceleration curve 4 corresponds to an amount of 45 to 35% of the distance of the abscissa intersections 5, 6 set at 100%.

For reducing excitations in the valve gear, the first acceleration curve 3 has a summit area 3''' with a constant acceleration course. Further, the intermediate curve 2 with the constant acceleration course 2' is connected in front of the second higher acceleration curve 4 between the connection points 7, 8.

In the closing range, the entire acceleration course illustrated in the sole FIGURE has a conventional closing acceleration course. Within the scope of the present invention, however, this conventional acceleration course can be replaced by the acceleration course 1 of the present invention. Further, the illustrated closing acceleration course with the opening acceleration course 1 according to the present invention can also be used in an inlet peripheral cam for actuating an inlet valve. In that case, the acceleration delay according to the present invention advantageously generates a dynamic valve gap for triggering a whirl formation. In addition, the mixture formation can also be influenced advantageously.

The invention is preferably used in multi-valve engines, particularly in four-valve engines.

What is claimed is:

1. Peripheral cam for a valve-controlled internal-combustion engine, comprising an opening flank with a cam contour configured to generate at least one positive acceleration course in a valve opening area, with an opening acceleration course having first and second acceleration curves with acceleration peak values of different amounts spaced by way of an intermediate curve of positive acceleration lower than the first and second acceleration curves, wherein the first acceleration curve has a peak value of approximately 40 to 60% of a peak value of the adjacent second acceleration curve set at 100%, an ascending curve section of the first acceleration curve and a descending curve section of the second acceleration curve each respectively intersecting with a zero acceleration line, and a distance between respective connection points of the descending curve section of the first acceleration curve and of the ascending curve section of the second acceleration curve with the intermediate curve corresponding to an amount of about 10 to 15% of the distance between the intersections at the zero acceleration line of the first and second acceleration curves.

2. Peripheral cam according to claim 1, wherein a contour of the opening flank is also configured such that a distance between a first intersection of the at least one intersection and the first projected connection point of the intermediate curve corresponds to an amount of about 45 to 50%, and a distance between the second projected connection point of the intermediate curve and the second intersection corresponds to an amount of about 45 to 35% of the distance between the intersections of the first and second acceleration curves at the zero acceleration line.

3. Peripheral cam according to claim 1, wherein the first acceleration curve has a summit area with a constant acceleration course.

4. Peripheral cam according to claim 3, wherein a contour of the opening flank also is configured such that a distance between a first intersection of the at least one intersection and the first projected connection point of the intermediate curve corresponds to an amount of about 45 to 50%, and a distance between the second projected connection point of the intermediate curve and the second intersection corresponds to an amount of about 45 to 35% of the distance between the intersections of the first and second acceleration curves at the zero acceleration line.

5. Peripheral cam according to claim 1, wherein the intermediate curve in sections between the connection points has a constant acceleration course.

6. Peripheral cam according to claim 5, wherein a contour of the opening flank also is configured such that a distance between first intersection of the at least one intersection and the first projected connection point of the intermediate curve corresponds to an amount of about 45 to 50%, and a distance between the second projected connection point of the intermediate curve and the second intersection corresponds to an amount of about 45 to 35% of the distance between the intersections of the first and second acceleration curves at the zero acceleration line.

7. Peripheral cam according to claim 6, wherein the first acceleration curve has a summit area with a constant acceleration course.

8. Peripheral cam according to claim 7, wherein a contour of the opening flank is configured such that a distance between a first intersection of the at least one intersection and the first projected connection point of the intermediate curve corresponds to an amount of about 45 to 50%, and a distance between the second projected connection point of the intermediate curve and the second intersection corresponds to an amount of about 45 to 35% of the distance between the intersections of the first and second acceleration curves at the zero acceleration line.

9. Method of using a peripheral cam, comprising an opening flank of the peripheral cam having a cam contour configured to generate at least one positive acceleration course in a valve opening area, with an opening acceleration course having first and second acceleration curves with acceleration peak values of different amounts spaced by way of an intermediate curve of positive acceleration lower than the first and second acceleration curve wherein the first acceleration curve has a peak value of approximately 40 to 60% of a peak value of the adjacent second acceleration curve set at 100%, an ascending curve section of the first acceleration curve and a descending curve section of the second acceleration curve each respectively intersecting with a zero acceleration line, and a distance between respective connection points of the descending curve section of the first acceleration curve and of the ascending curve section of the second acceleration curve with the intermediate curve corresponding to an amount of about 10 to 15% of the distance between the intersections of the first and second acceleration curves at the zero acceleration line, comprising the step of using the peripheral cam as a cam for actuating one of an inlet valve and an outlet valve.

10. Method of using a peripheral cam according to claim 9, wherein the first acceleration curve has a summit area with a constant acceleration course.

11. Method of using a peripheral cam according to claim 10, wherein a contour of the opening flank is configured such that a distance between a first intersection of the at least one intersection and the first projected connection point of the intermediate curve corresponds to an amount of about 45 to 50%, and a distance between the second projected connection point of the intermediate curve and the second intersection corresponds to an amount of about 45 to 35% of the distance of the between intersections of the first and second acceleration curves at the zero acceleration line.

12. Method of using a peripheral cam according to claim 11, wherein the intermediate curve in sections between the connection points has a constant acceleration course.

* * * * *